United States Patent [19]

Herrenschmidt

[11] 4,179,585

[45] Dec. 18, 1979

[54] VARIABLE RATIO FULL RANGE DIRECT-REFLECTED PYRAMID INCLINED LOUDSPEAKER

[76] Inventor: Gilles R. Herrenschmidt, 71 rue de Passy, 75016 Paris, France

[21] Appl. No.: 904,330

[22] Filed: May 9, 1978

[30] Foreign Application Priority Data

Oct. 27, 1977 [FR] France ..... 77 32517

[51] Int. Cl.[2] ..... H04R 1/20

[52] U.S. Cl. ..... 179/1 E; 181/147; 181/154

[58] Field of Search ..... 179/1 E; 181/144, 145, 181/146, 147, 154

[56] References Cited

U.S. PATENT DOCUMENTS

| | | | |
|---|---|---|---|
| 2,544,742 | 3/1951 | Volf | 181/145 |
| 2,792,065 | 5/1957 | Gately, Jr. | 181/145 |
| 2,824,617 | 2/1958 | Roulet | 181/145 |
| 3,101,810 | 8/1963 | Doschek | 181/199 |
| 3,720,787 | 3/1973 | Ishii et al. | 179/1 E |
| 4,006,308 | 2/1977 | Ponsgen | 179/1 E |
| 4,073,365 | 2/1978 | Johnson | 181/154 |

FOREIGN PATENT DOCUMENTS

| | | | |
|---|---|---|---|
| 564955 | 8/1958 | Belgium | 181/144 |
| 1199441 | 12/1959 | France | 179/1 E |

*Primary Examiner*—George G. Stellar
*Attorney, Agent, or Firm*—Robert T. Tobin

[57] ABSTRACT

A loudspeaker system comprising an enclosure having first and second sidewalls, at least one of which is inclined to the vertical direction and at least one acoustic transducer adjacent each of the aforesaid sidewalls.

5 Claims, 8 Drawing Figures

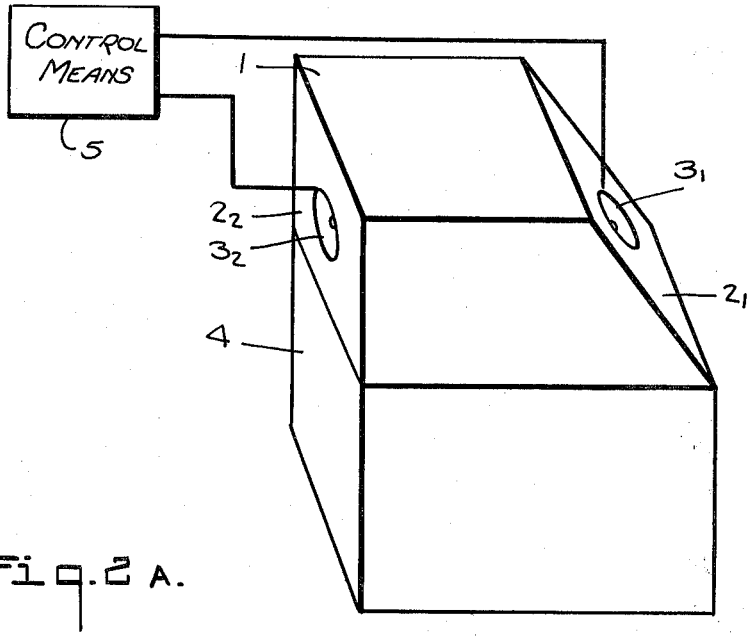
Fig. 1.
Fig. 2 A.
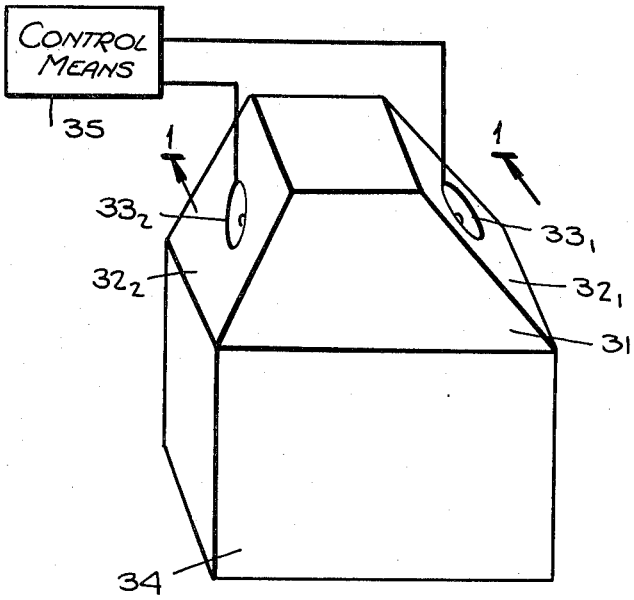
Fig. 2 B.
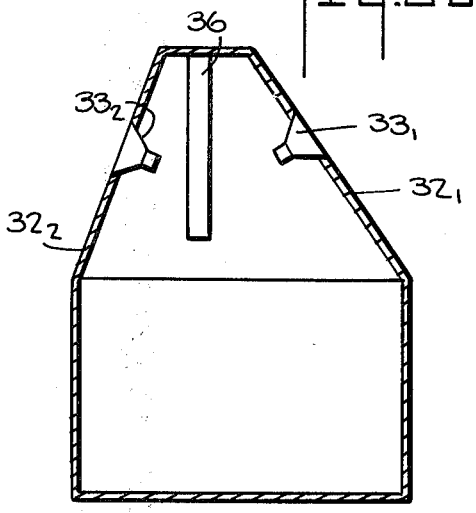
Fig. 6 A.
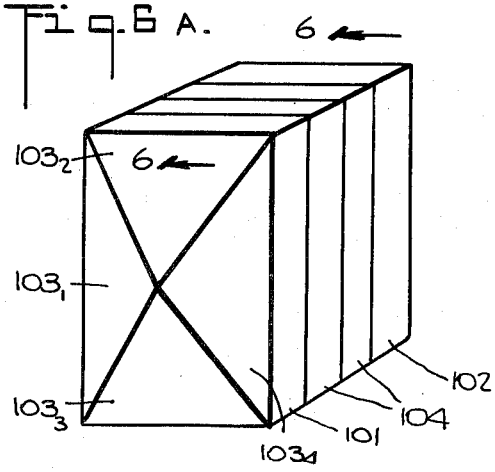
Fig. 6 B.
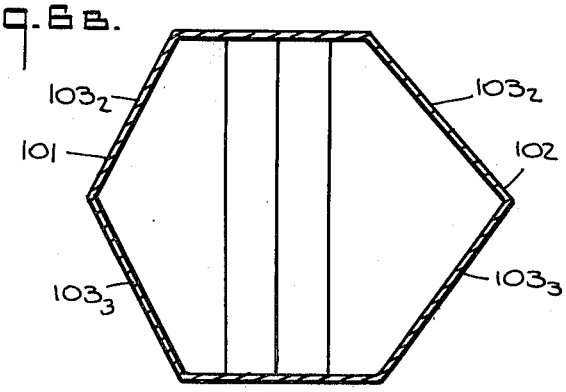

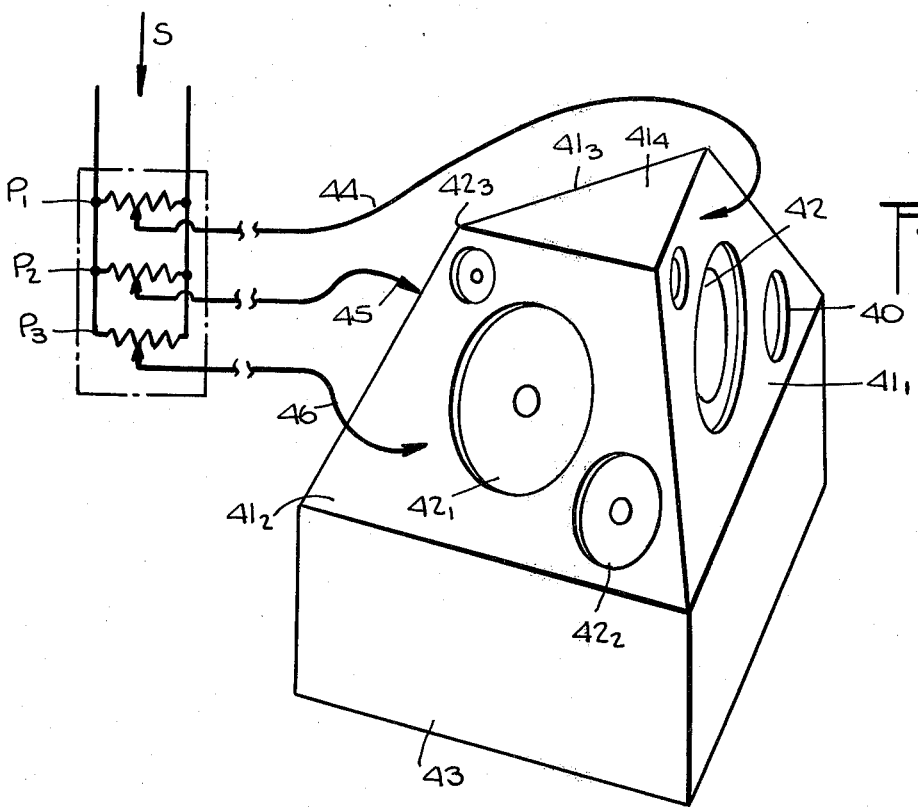
Fig. 3.
Fig. 4.
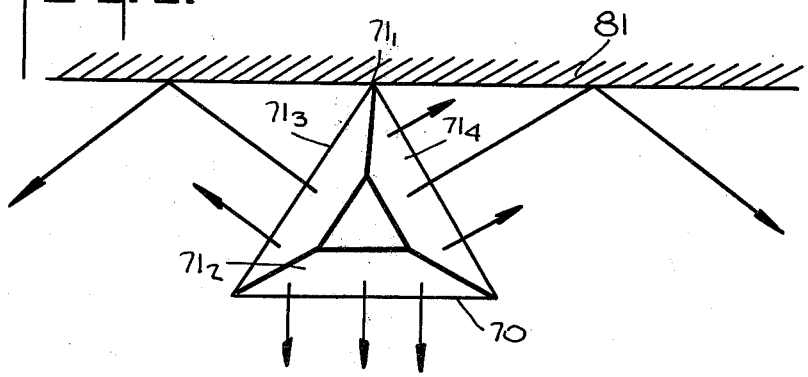
Fig. 5.
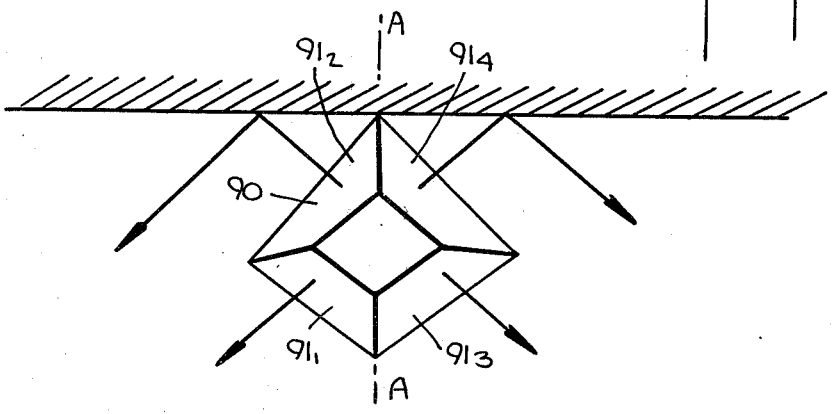

VARIABLE RATIO FULL RANGE DIRECT-REFLECTED PYRAMID INCLINED LOUDSPEAKER

BACKGROUND OF THE INVENTION

1. Field of the Invention

This invention relates to loudspeaker systems and, in particular, to loudspeaker systems which employ enclosures having a number of sidewalls through which sound is directed.

2. Description of the Prior Art

Loudspeaker systems of the above type are generally known wherein the enclosure of the speaker is comprised of a number of sidewalls against some of which are disposed transducers for propagating sound out of the enclosure. U.S. Pat. No. 3,582,553 discloses one such loudspeaker system wherein the enclosure comprises five interconnected sidewalls. These sidewalls are all vertical. Acoustic transducers are arranged adjacent a first sidewall and two further sidewalls opposite the first sidewall and intersecting each other at an oblique angle. This first sidewall and two opposing sidewalls are referred to as baffles. This patent further states that "the baffle may be tilted upward or downward for low and high locations, respectively, of the system."

The aforesaid prior art loudspeaker systems, however, suffer from distortion problems, due to the arrangement of the sidewalls in parallel orientation to the vertical direction. In particular, these systems give rise to circulating standing acoustic waves which prevent the systems from closely approximating an ideal vibrating spherical surface. Moreover, these systems are limited in their use, since they are required to be spaced a set distance from the walls of a room and since they must be placed so that the furniture of the room is not closely adjacent the area from which the speaker sound propagates.

It is, therefore, an object of the present invention to provide a loudspeaker system which more closely approximates an ideal pulsating spherical surface.

It is a further object of the present invention to provide a speaker system which more closely simulates the direct and reflected sounds and the ratio thereof of the recording hall wherein the music being played was recorded.

SUMMARY OF THE INVENTION

In accordance with the principles of the present invention, the above and other objectives are accomplished in a loudspeaker system comprised of an enclosure including first and second sidewalls, at least one of which (the first sidewall) is inclined to the vertical direction, and at least one acoustic transducer adjacent each of the aforesaid sidewalls.

With the speaker system of the present invention, reflected or indirect sound energy is generated such that undesired resonances both inside and outside the system enclosure are reduced. As a result, the sound of the system more closely approximates that of an ideal pulsating spherical surface than prior art loudspeaker systems. Hence, the speaker provides a more faithful reproduction of the recorded transmission. Moreover, speaker performance is less dependent on the acoustics of the room wherein the speaker is placed. Thus, an overall speaker system providing enhanced performance and adaptability results.

In a first embodiment of the invention to be disclosed hereinafter, the other or second sidewall of the enclosure is parallel to the vertical direction. In a second embodiment, the second sidewall as well as the first sidewall are inclined to the vertical direction.

Advantageously, in yet further embodiments of the invention, the enclosure of the speaker system includes at least a further or third sidewall adjacent which a transducer is arranged and the three or more sidewalls are all inclined to the vertical direction to form a pyramid like enclosure.

In still a further aspect of the invention, the speaker system of the invention is additionally provided with means for independently adjusting the transducers adjacent each of the speaker sidewalls to independently vary the acoustic sound energy propagating therefrom.

BRIEF DESCRIPTION OF THE DRAWINGS

The above and other features and aspects of the present invention will become more apparent upon reading the following detailed description in conjunction with the accompanying drawing, in which:

FIG. 1 shows a first embodiment of a speaker system in accordance with the principles of the present invention, wherein the speaker comprises an enclosure having a single inclined sidewall;

FIGS. 2A and 2B illustrate a second embodiment of a speaker system in accord with the invention, wherein the speaker system comprises an enclosure having two inclined sidewalls;

FIG. 3 shows, in perspective view, a third embodiment of a speaker system in accord with the invention, wherein the speaker system comprises an enclosure having three inclined sidewalls which form a pyramid;

FIG. 4 illustrates a top view of a fourth embodiment of a speaker system in accord with the invention, wherein the speaker comprises an enclosure having three inclined sidewalls which form a regular pyramid;

FIG. 5 shows a top view of a fifth embodiment of a speaker system in accord with the invention, wherein the speaker comprises an enclosure having four inclined sidewalls which form a quadrangular pyramid; and FIGS. 6A and 6B illustrate a sixth embodiment of a speaker system in accord with the invention, wherein the speaker system comprises two back to back pyramidal enclosures.

DETAILED DESCRIPTION

FIG. 1 illustrates a speaker system in accordance with the principles of the present invention. The system comprises an enclosure 1 having first and second sidewalls $\mathbf{2}_1$ and $\mathbf{2}_2$ through which sound is propagated. The first sidewall $\mathbf{2}_1$ is inclined or slanted to the vertical direction, while the second sidewall $\mathbf{2}_2$ is parallel to such direction. Disposed adjacent and facing the sidewalls $\mathbf{2}_1$ and $\mathbf{2}_2$ are transducers $\mathbf{3}_1$ and $\mathbf{3}_2$, respectively. As shown, the enclosure 1 is further supported on a base or stand 4 to give it added height and volume.

As can be appreciated, when the speaker system of FIG. 1 is situated within a conventional room, the transducer $\mathbf{3}_1$ adjacent the inclined wall $\mathbf{2}_1$ will generate sound energy which propagates obliquely to the walls of the room and, thus, will be reflected thereby in all directions. As a result, the speaker system will recreate not only the direct sounds of the recording being reproduced, but the indirect or reflected sounds in all directions as well. Accordingly, the system will produce a highly faithful reproduction of such recording.

Preferably, when using the speaker system of FIG. 1, the inclined sidewall $2_1$ should be situated away from the central portion of the room and the sidewall $2_2$ toward such central portion. In this manner, the transducer $3_2$ adjacent the sidewall $2_2$ will essentially recreate the direct sounds of the recording and the transducer $3_1$ adjacent the sidewall $2_1$ the indirect or reflected sounds.

The speaker system of FIG. 1 is also provided with a control means 5 for independently controlling the level of sound energy being generated by the transducers $3_1$ and $3_2$. Typically, such a means might be a parallel connection of potentiometers. The control means 5, thus, permits adjustment of the sound energy from the transducers $3_2$ and $3_1$ and thereby the adjustment of the direct and indirect or reflected energy being created by the speaker system. By so adjusting the direct and indirect sound energy, the ratios of these energies can be controlled to produce various listening effects. Thus, if one wishes to create the impression of being in the rear section of a concert hall one can increase the amount of indirect energy relative to the amount of direct energy. On the other hand, if one wishes to create the impression of being in front of a concert hall, one can increase the amount of direct energy relative to the indirect energy. Finally, one can increase or decrease the indirect sound energy relative to the direct sound energy to create the impression of concert halls of different size.

FIG. 2A shows a second embodiment of a speaker system in accord with the invention wherein the speaker system comprises an enclosure 31 having first and second sidewalls $32_1$ and $32_2$ both of which are inclined to the vertical direction. The enclosure 31 is supported on a base 34 and the speaker system is provided with control means 35 for independently controlling the transducers $33_1$ and $33_2$ adjacent the sidewalls $32_1$ and $32_2$. As seen more clearly in FIG. 2B, which is a cross section of the speaker of FIG. 2A taken along the line 1—1, the inclination of the sidewall $32_1$ relative to the vertical direction is greater than that of the sidewall $32_2$. As a result, the transducer $33_1$ adjacent the sidewall $32_1$ will tend to result in energy being reflected in all directions to a greater extent than the transducer $33_2$ adjacent the sidewall $32_2$. In use, therefore, the sidewall $32_2$ will generally be situated toward the open area of a room to recreate the direct sounds of the recording being reproduced and the sidewall $32_1$ away from such open areas and toward the room walls to recreate the indirect sounds of such recording. Advantageously, the sidewall $32_1$ can be inclined at an angle of 45 degrees and the sidewall $32_2$ at an angle of 15 degrees relative to the vertical direction. As can also be seen from FIG. 2B, the speaker is also provided with a baffle plate 36 which separates the transducer $33_1$ from the transducer $33_2$.

As is apparent, due to the inclined disposition of both the sidewalls $32_1$ and $32_2$ of the speaker system of FIG. 2A, all the sound energy from both the transducers $32_1$ and $32_2$ will be propagated so as to obliquely strike all the reflecting surfaces (walls, ceiling and floor) of a room within which the speaker is placed. Additionally, the plate 36 helps keep the in-phase movement of the cones of the two transducers. The low frequency reproduction by the speaker system will thus be enhanced.

FIG. 3 shows a further embodiment of the present invention wherein a speaker system is provided which includes first, second and third sidewalls $41_1$,$41_2$ and $41_3$ all of which are inclined to the vertical direction and which together form a pyramidal enclosure 40.

In the present illustrative case, the first, second and third sidewalls $41_1$, $41_2$ and $41_3$ are trapezoidal in configuration and are each inclined at an angle of 15 degrees relative to the vertical. The resultant enclosure 40 thus has a truncated upper portion, this upper portion being closed off by a triangular upper wall $41_4$.

The speaker system is further provided within the enclosure 40 and adjacent each of the enclosure sidewalls with at least one acoustic transducer 42 for propagating sound energy therethrough. As shown, three transducers are arranged adjacent each of the aforesaid sidewalls. These transducers are of three sizes designed to reproduce low frequencies, mid-range frequencies, and high frequencies, and high frequencies. Thus, for example, in FIG. 3, the transducer adjacent the sidewall $41_2$ enumerated as $42_1$ reproduces low frequencies, the transducer enumerated as $42_2$ reproduces mid-range frequencies and the transducer enumerated as $42_3$ high frequencies.

As with the speaker of FIG. 2A, due to the incline in the enclosure sidewalls $41_1$, $41_2$ and $41_3$ of the speaker of FIG. 3, none of these sidewalls will be parallel or orthogonal to the reflecting surfaces (walls, ceiling and floor) of a conventional room when the speaker is disposed therein. The acoustic vibrations or sound energy emitted by the transducers adjacent these sidewalls will thus impinge on these surfaces of the room at oblique angles and will be reflected therefrom in all directions. As a result, the sound energy produced in the room will be substantially at the original sound level at which it was generated for all frequencies (low, high and mid-range) and, hence, will provide a faithful reproduction of the recorded sound.

To provide an even closer reproduction of extremely low frequencies as, for example, frequencies within the range 20 to 60 hz., the enclosure 40 can be further provided with an additional loudspeaker disposed adjacent its bottom wall. In such case, the enclosure will provide extremely excellent reproduction from the low frequency of 20 hz to the high frequencies normally encountered in speaker systems.

As with the other speaker systems, the speaker system of FIG. 3 is also provided with a base or stand 43 for supporting the enclosure 40. The use of the stand 43 permits the enclosure 40 to be situated at a given height in a room and to have an increased volume without having to significantly enlarge its dimensions. Thus, the size of the enclosure can be kept relatively small.

It should be pointed out that the sidewalls $41_1$, $41_2$ and $41_3$, instead of having trapezoidal configurations, could also have had triangular configurations. In such case, the enclosure 40 formed by the sidewalls would have a sharp apex.

The loudspeaker system of FIG. 3 is also provided with means for independently adjusting the sound energy being propagated by the transducers 42 adjacent the respective sidewalls of the enclosure 40. As a result, the sound energy propagating from each one of the sidewalls can be adjusted relative to that propagating from the other sidewalls. This, in turn, permits adjustment of the direct and reflected sound energy being generated by the speaker system as desired.

More particularly, as shown, the aforesaid adjusting means comprises three potentiometers $P_1$, $P_2$ and $P_3$, connected in parallel and fed by an amplifier S. The pickoffs of these potentiometers are independently adjustable and are connected to respective lines 44, 45 and 46 feeding the transducers adjacent the sidewalls $41_1$, $41_2$ and $41_3$. While not shown, further potentiometer arrangements can also be inserted in each of these lines to permit independent adjustment of the signal levels of the transducers being fed thereby. Thus, for example, three parallel arranged potentiometers can be arranged in the line 46 so as to permit feeding the transducers $42_1$, $42_2$ and $42_3$ at different signal levels.

FIG. 4 shows a top view of a further embodiment of a speaker system in accordance with the invention. In this embodiment, the speaker system includes three similarly dimensioned, trapezoidal inclined sidewalls $71_2$, $71_3$ and $71_4$ which together form an enclosure 70 having the form of a regular pyramid. With this type of construction, the enclosure 70 can be placed against a wall 81 so that the junction point $71_1$ of two of its sidewalls $71_3$ and $71_4$ is adjacent the wall. In such case, direct sounds will emanate from the sidewall $71_2$ of the enclosure and direct or reflected sounds will be produced via the sounds emanating from the sidewalls $71_3$ and $71_4$, and reflected by the wall 81. These indirect sounds, moreover, will be dispersed because of the symmetrical disposition of the aforesaid sides with respect to a line orthogonal to the wall 81. Alternatively, it should be pointed out that the enclosure 70 can also be positioned in the room in other orientations to accommodate the acoustics of the room, the furniture within the room and the particular ear of the listener.

FIG. 5 shows still a further embodiment of the speaker system of the invention wherein the speaker comprises an enclosure 90 formed by four inclined, trapezoidal sidewalls $91_1$, $91_2$, $91_3$ and $91_4$. Thus, in this case, the enclosure 90 has the form of an irregular quadrangular pyramid. The enclosure is, however, formed so as to be symmetric with respect to the line A—A passing through a diagonal of the base of the enclosure. More particularly, this is accomplished by forming the sidewalls $91_1$ and $91_2$ to have the same shape and dimensions as the sidewalls $91_3$ and $91_4$, respectively. This symmetrical type configuration permits a balancing of the sounds being reproduced by the speaker system. While not shown in this construction, the transducers adjacent the sidewalls can be independently adjusted for achieving such balance.

Typically, if stereophonic reproduction is desired, two speaker systems according to the invention will in general be required. However, such reproduction can also be accomplished using the speaker system of FIG. 5 by driving the transducers adjacent the sidewalls $91_1$ and $91_2$ by one channel of the stereophonic program and the loudspeakers adjacent the symmetrically arranged sidewalls $91_3$ and $91_4$ by the other stereophonic channel.

FIGS. 6A and 6B illustrate another embodiment of the speaker system of the present invention. This speaker system comprises two enclosure sections 101 and 102, only one of which (i.e., enclosure section 101) can be specifically seen in FIG. 6A. Each of the sections comprises four inclined, triangular sidewalls $103_1$, $103_2$, $103_3$ and $103_4$. The sections 101 and 102 thus have the form of quadrangular pyramids. The sections are also provided with bases 104 along which the sections are joined or connected to form a single enclosure. As shown, these bases support the sections so that the resultant has apexes which lie in a horizontal plane.

As can be seen in FIG. 6B, the sidewalls of the section 102 are inclined to a greater degree than the sidewalls of the section 101. Thus, as shown, the sidewalls $103_2$ and $103_3$ of the section 102 are at an angle of 45 degrees relative to the vertical direction and the sidewalls $103_2$ and $103_3$ of the section 102 are at an angle of 45 degrees relative to the vertical direction. This permits the section 101 to be used to create direct sounds and the section 102 to be used to create indirect sounds by placement of the speaker with the section 101 directed to the open area of a room and the section 102 directed toward the walls of such a room.

In all cases it is understood that the above described arrangements are merely illustrative of the many possible specific embodiments which represent applications of the present invention. Numerous and varied other arrangements can be readily devised without departing from the spirit and scope of the invention.

What is claimed is:

1. A loudspeaker arrangement adapted to provide variable direct and reflected sounds at a desired ratio with the loudspeaker arrangement disposed adjacent a wall external to the speaker enclosure and disposed between said wall and a listening area, including means for producing reflected sounds including first and second sidewalls of a truncated pyramid formed enclosure, said first and second sidewalls including acoustic transducers and meeting at a junction with the junction being adjacent and facing said will with the first and second sidewalls being directed at the wall with sound emanating from the first and second sidewalls striking the wall before being reflected toward the listening area;

means for producing direct sounds having relatively high, middle and low sound frequencies, said direct sound producing means including the third sidewall of the pyramid formed enclosure, and including acoustic transducers for producing at least low sound frequencies and mid-range sound frequencies with the third sidewall and the included transducers being disposed opposite said junction and facing the listening area and having an angle with respect to the vertical of approximately 15° so that sound emanating from said third sidewall will reach a listener before being reflected by surfaces external to the speaker arrangement, control means for increasing and decreasing the quantity of reflected sound relative to direct sound including means for respectively increasing and decreasing the output of transducers in the first and second sidewalls relative to the output of the transducer in the third sidewall.

2. A loudspeaker system arrangement adapted to provide direct and reflected sounds in a variable and desired ratio with relatively high, middle and low sound frequencies being included in both the direct and reflected sounds and having a speaker enclosure disposed adjacent a wall external to the speaker enclosure and disposed between said wall and a listening area including:

(a) an enclosure having a first, a second, and a third sidewall, each of said sidewalls being inclined to the vertical direction with said enclosure having the form of a pyramid having junctions formed between the three sidewalls;

(b) each of said inclined sidewalls including an acoustic transducer arrangement having at least acoustic transducer means for producing relatively low frequencies with the transducers being inclined to the vertical as are the sidewalls;

(c) means for reducing resonances including a hollow base mounted below the pyramid formed enclosure;

(d) means for varying the ratio of direct and reflected sounds, including (i) means for producing reflected sounds, said reflected sound producing means including said first and said second sidewalls and at least said wall external to the speaker enclosure, the speaker enclosure being placed adjacent said wall, the junction between said first and second sidewalls arranged so as to face directly the wall with said first and second sidewalls both being directed at acute angles to said wall with sound emanating from said first and second sidewalls striking said wall at acute angles before being reflected away from said wall;

(ii) means for producing direct sounds, said direct sound producing means including said third sidewall, said third sidewall located opposite said junction and arranged to face away from said wall and toward said listening area.

(iii) control means for increasing and decreasing the quantity of reflected sounds relative to the direct sounds including means for respectively increasing and decreasing the output of the acoustic transducers in said first and second sidewalls relative to the output of the acoustic transducer in the third sidewall.

3. The loudspeaker arrangement according to claim 2 wherein the angle at which at least the third sidewalls is disposed with respect to the vertical is approximately 15°.

4. The arrangement according to claim 3 wherein the angle at which said first and second sidewalls are disposed with respect to the vertical is approximately 15°.

5. The arrangement according to claim 2 or 4 wherein said enclosure has the form of a truncated pyramid.

* * * * *